United States Patent [19]

Kim

[11] 4,454,397

[45] Jun. 12, 1984

[54] PUSH BUTTON SWITCH ASSEMBLY

[75] Inventor: Syng N. Kim, Hoffman Estates, Ill.

[73] Assignee: Wico Corporation, Niles, Ill.

[21] Appl. No.: 391,103

[22] Filed: Jun. 23, 1982

[51] Int. Cl.[3] ..... H01H 13/04

[52] U.S. Cl. ..... 200/296; 200/153 T; 200/295; 200/330

[58] Field of Search ..... 200/295, 330, 153 T, 200/331, 283, 296, 295

[56] References Cited

U.S. PATENT DOCUMENTS

| | | | |
|---|---|---|---|
| 2,740,023 | 3/1956 | Kryder | 200/296 |
| 2,789,176 | 4/1957 | Mercier | 200/153 T |
| 2,889,125 | 6/1959 | Hart | 248/27.3 |
| 3,047,699 | 7/1962 | Patti | 200/159 A |
| 3,119,909 | 1/1964 | Cutler | 200/295 X |
| 3,225,155 | 12/1965 | Duncan | 200/51.09 |
| 3,249,726 | 5/1966 | Long | 200/295 X |
| 3,377,454 | 4/1968 | Faggiano | 200/295 |
| 3,594,529 | 7/1971 | Cartwright | 200/330 |
| 4,159,405 | 6/1979 | Semonchik et al. | 200/296 |
| 4,196,328 | 4/1980 | Ishikawa | 200/283 X |

FOREIGN PATENT DOCUMENTS

| | | | |
|---|---|---|---|
| 694973 | 9/1964 | Canada | 200/153 T |

OTHER PUBLICATIONS

Moulor Switch Assembly–Photographs Provided by Applicant.

*Primary Examiner*—John W. Shepperd
*Assistant Examiner*—Renee S. Kidorf
*Attorney, Agent, or Firm*—Emrich & Dithmar

[57] ABSTRACT

A push button switch assembly includes a base having an internally threaded aperture therethrough and a cylindrical housing closed at one end by a circular end wall having a cylindrical bushing portion which is threadedly engaged in the base aperture. A mounting member surrounds the bushing portion and is clamped between the base and the housing, the mounting member having resilient arms respectively received in corresponding recesses in the housing and projecting therefrom adjacent to the other end of the housing for resilient gripping engagement with an associated support wall in which the assembly is mounted. An actuator reciprocates in the bushing portion and is coupled to a push button disposed at the open end of the housing, the actuator engaging the contact means of a switch which is secured between attachment members on the base. Two different bases are provided for respectively mounting a microswitch or a leaf switch.

11 Claims, 9 Drawing Figures

FIG. 1
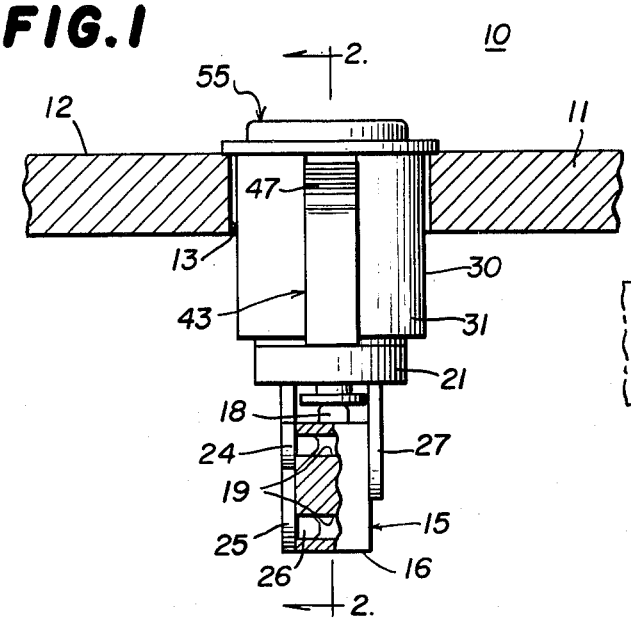
FIG. 2
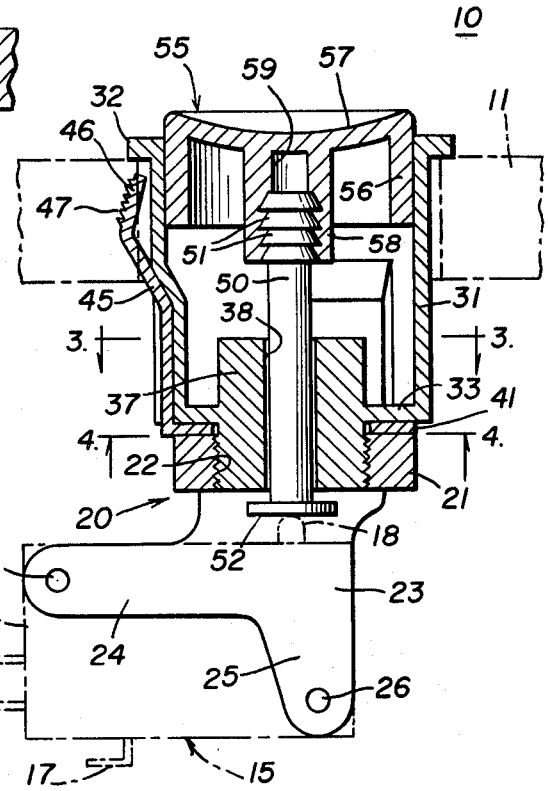
FIG. 3
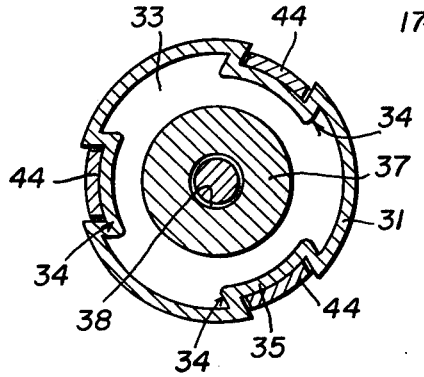
FIG. 4
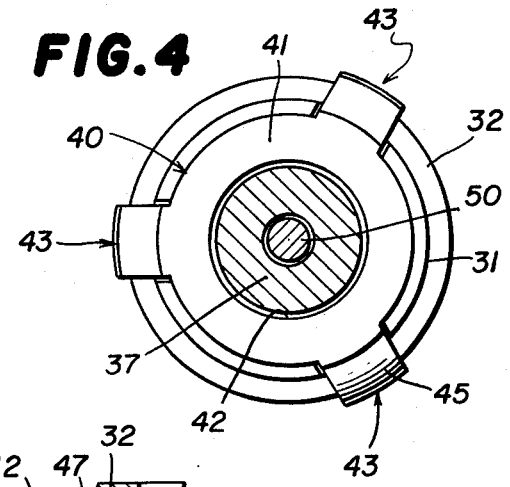
FIG. 5
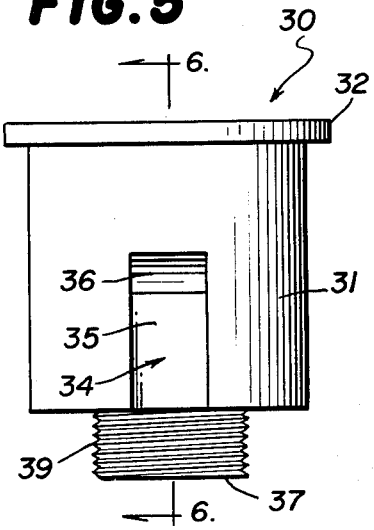
FIG. 6
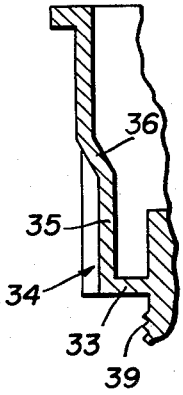
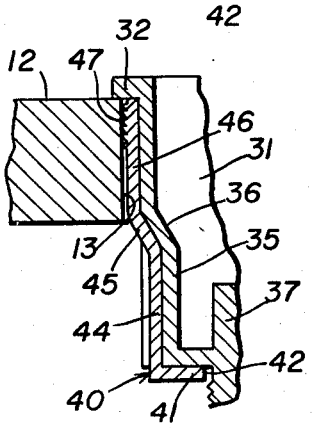
FIG. 7

PUSH BUTTON SWITCH ASSEMBLY

BACKGROUND OF THE INVENTION

The present invention relates to push button switch assemblies of the type to be mounted in an aperture in a support panel.

Prior push button switch assemblies have been relatively complex and expensive constructions, including a relatively large number of parts characterized by relative difficulty of assembly. Furthermore, prior push button switch assemblies are typically adapted for use with a single type of switch. The switch is typically mounted in place by fasteners which necessitate the use of tools.

SUMMARY OF THE INVENTION

It is a general object of this invention to provide an improved push button switch assembly which avoids the disadvantages of prior switch assemblies, while affording additional structural and operating advantages.

It is an important object of the invention to provide a push button switch assembly which is of simple and economical construction, characterized by a small number of parts.

In connection with the foregoing object, it is another object of this invention to provide a push button switch assembly of the type set forth wherein the parts can be assembled without the use of tools.

In connection with the foregoing objects, it is another object of this invention to provide a push button switch assembly of the type set forth, which includes interchangeable parts for readily adapting the assembly for use with different types of switches.

Yet another object of this invention is the provision of a push button switch assembly wherein the switch can be connected to the assembly without the use of tools.

These and other objects of the invention are attained by providing a push button assembly for mounting in an aperture in an associated support wall, the assembly comprising a base, a housing carried by the base including a peripheral side wall and an end wall closing the side wall at one end thereof, the end wall having an aperture therethrough, the side wall having a plurality of spaced-apart elongated recesses therein extending from the end wall toward the other end of the housing, a mounting member coupled to the base and having a plurality of resilient arms respectively disposed in the recesses and projecting outwardly therefrom adjacent to the other end of the housing for resilient gripping engagement with the associated support wall, an actuator member extending through the aperture in the end wall for sliding reciprocating movement axially thereof, and push button means coupled to the inner end of the actuator member for movement therewith and disposed for access by a user at the other end of the housing.

The invention consists of these and other novel features and a combination of parts hereinafter fully described, illustrated in the accompanying drawings, and particularly pointed out in the appended claims, it being understood that various changes in the details may be made without departing from the spirit or sacrificing any of the advantages of the invention.

BRIEF DESCRIPTION OF THE DRAWINGS

FIG. 1 is a side elevational view of a push button switch assembly constructed in accordance with and embodying the features of a first embodiment of the present invention, shown mounted in place in an aperture in an associated support panel, and with a portion of the switch body broken away more clearly to illustrate the manner of mounting thereof;

FIG. 2 is an enlarged view in vertical section, taken along the line 2—2 in FIG. 1, with the switch illustrated in phantom;

FIG. 3 is a view in horizontal section, taken along the line 3—3 in FIG. 2;

FIG. 4 is a view in horizontal section, taken along the line 4—4 in FIG. 2;

FIG. 5 is a side elevational view of the housing of the switch assembly of FIG. 1;

FIG. 6 is a fragmentary view in vertical section, taken along the line 6—6 in FIG. 5;

FIG. 7 is a view similar to FIG. 6, with the mounting member in place and illustrating the manner in which it cooperates with the associated support panel;

DESCRIPTION OF THE PREFERRED EMBODIMENTS

Figure 8:
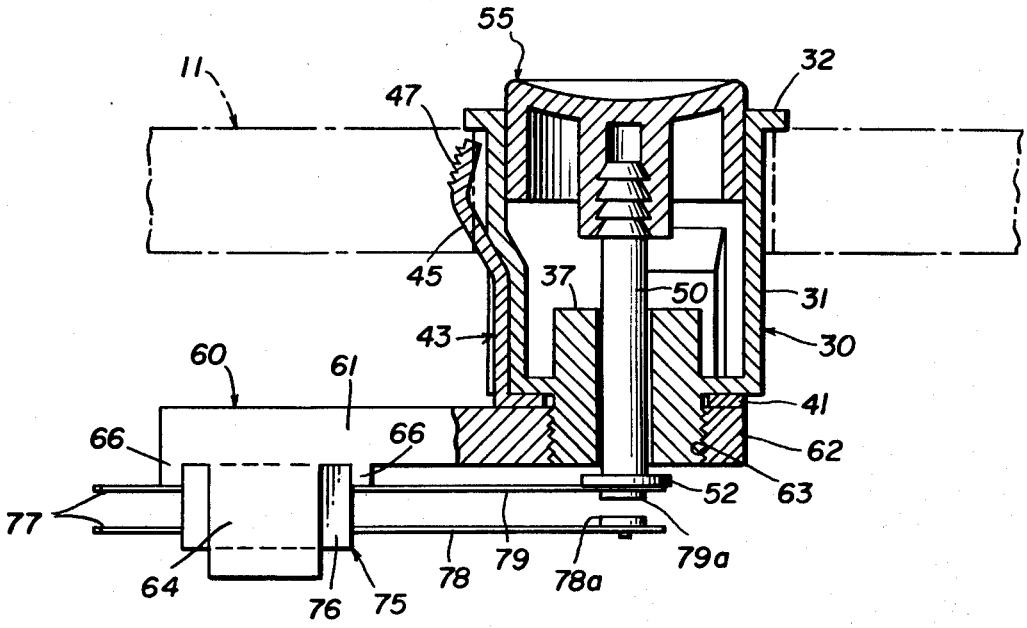
FIG. 8 is a view similar to FIG. 2, illustrating a push button switch assembly constructed in accordance with and embodying the features of a second embodiment of the present invention.

Referring to FIGS. 1 and 2 of the drawings, there is illustrated a push button switch assembly, generally designated by the numeral 10, constructed in accordance with and embodying the features of a first embodiment of the present invention for use with a microswitch, generally designated by the numeral 15. The switch assembly 10 is illustrated in its mounted configuration in a support panel 11 which has an outer surface 12, the switch assembly 10 being disposed in a circular mounting aperture 13 in the support panel 11.

The microswitch 15 is of conventional construction, including a housing 16 provided with terminals 17, and an actuating plunger 18. Additionally, the switch housing 16 is provided with a pair of bores 19 therein to facilitate connection thereof in the switch assembly 10, as will be explained more fully below.

Referring now also to FIGS. 3 through 7 of the drawings, the switch assembly 10 includes a base, generally designated by the numeral 20, which has a cylindrical body 21 provided with an internally threaded opening 22 extending therethrough centrally thereof. Integral with the body 21 and extending therefrom generally parallel to the axis of the opening 22 is a flat main plate 23 of irregular shape, including an elongated arm 24 and a shorter arm 25, extending generally normal to each other. Respectively integral with the arms 24 and 25 adjacent to the distal ends thereof and projecting in the same direction therefrom substantially normal thereto are two short stakes 26. Also integral with the body 21 and extending therefrom in the same direction as the main plate 23 substantially parallel thereto and spaced a predetermined distance therefrom is a flat, rectangular retaining plate 27, which preferably does not extend as far as the stakes 26.

The switch assembly 10 also includes a housing, generally designated by the numeral 30, which has a generally cylindrical side wall 31 provided at one end thereof with a radially outwardly extending annular flange 32. The side wall 31 is closed at the other end thereof by a circular end wall 33. The side wall 31 has, at equiangularly spaced-apart locations therearound, three axially elongated recesses, each generally designated by the numeral 34. Each of the recesses 34 is defined by a vertical wall portion 35 displaced radially inwardly of the side wall 31, and having the upper end thereof connected to the main part of the side wall 31 by a sloping wall portion 36. Integral with the end wall 33 and coaxial therewith is a cylindrical bushing 37 which extends approximately equal distances inwardly and outwardly of the housing 30, the bushing 37 having a cylindrical bore 38 extending axially therethrough. The outer end of the bushing 37 is externally threaded, as at 39 (see FIG. 6), and is adapted to be threadedly engaged in the threaded opening 22 of the base 20.

The switch assembly 10 also includes a mounting member, generally designated by the numeral 40, which has a generally circular flat base portion 41 provided with a circular aperture 42 therethrough centrally thereof and dimensioned for accommodating therethrough the bushing 37 of the housing 30. Integral with the base portion 41 at the outer periphery thereof and projecting therefrom generally normal thereto are three equiangularly spaced-apart resilient mounting arms 43. Each of the mounting arms 43 has a vertical portion 44 integral at one end thereof with the base portion 42 and integral at the other end thereof with the radially outwardly inclined portion 45, the inclined portion 45 being in turn integral with a radially inturned tip 46 provided on the outer surface thereof with a plurality of serrations 47. The diameter of the base portion 41 is slightly less than the diameter of the side wall 31 of the housing 30, and the mounting arms 43 are dimensioned and positioned respectively to be received in the recessed portions 34 of the side wall 31.

In assembly, the mounting member 40 is first fitted over the threaded end of the bushing 37, with the mounting arms 43 respectively received in the recesses 34, as is best illustrated in FIG. 2. More specifically, the vertical portions 44 of the mounting arms 43 lie along the vertical wall portions 35 of the recesses 34, while the inclined portions 45 lie along the sloping wall portions 36 and extend outwardly well beyond the outer surface of the cylindrical side wall 31. The inturned tips 46 of the mounting arms 43 terminate a predetermined distance from the annular flange 32 and preferably slightly spaced from the cylindrical side wall 31.

The switch assembly 10 also includes an elongated actuator rod 50 provided at one end thereof with a plurality of enlarged-diameter frustoconical ribs 51 (see FIG. 2) and provided at the other end thereof with an enlarged-diameter circular end plate 52. Preferably, the diameter of the frustoconical ribs 51 is very slightly greater than the diameter of the bore 38 in the bushing 37. The slope of the ribs 51 is radially outwardly toward the other end of the actuator rod 50 so as to accommodate a slight cammed deflection or deformation thereof to permit insertion thereof through the bore 38 from the outer end thereof, but to prevent retrograde movement of the ribs 51 back through the bore 38. In this manner, the actuator rod 50 is assembled with the housing 30 and is adapted for reciprocating movement axially thereof, this movement being limited by engagement of the first rib 51 and the end plate 52, respectively, with the opposite ends of the bushing 37.

The ribbed end of the actuator rod 50 is coupled to a push button, generally designated by the numeral 55. The push button 55 has a cylindrical side wall 56 dimensioned to be slidably received in the open end of the housing 30 and closed at the outer end thereof by a concave top wall 57. Integral with the top wall 57 centrally thereof and projecting inwardly therefrom beyond the other end of the side wall 56 is a cylindrical attachment post 58 provided with a cylindrical coaxial bore 59 in the distal end thereof. The bore 59 has a diameter less than that of the ribs 51, and is adapted to have the ribbed end of the actuator rod 50 press fitted thereinto. Attempted retrograde movement of the push button 55 will cause the ribs 51 to embed in the attachment post 58 thereby effectively preventing removal of the push button 55. It will be appreciated that the push button 55 is reciprocally movable with the actuator rod 50, the movement of the actuator rod 50 being guided by the elongated bushing 37, and the movement of the push button 55 being guided by the cylindrical side wall 31 of the housing 30. Engagement of the push button side wall 56 with the sloping wall portions 36 of the housing 30, and/or engagement of the attachment post 58 with the bushing 37, will serve to limit depression of the push button 55.

In mounting the switch assembly 10 on the support panel 11, the mounting member 40 is preferably first assembled with the housing 30 in the manner described above, and then the actuator rod 50 and the push button 55 are assembled with the housing 30. This subassembly is then mounted in the mounting aperture 13 of the panel 11, by inserting the bushing end of the housing 30 into the aperture 13 from the outer end thereof until the annular flange 32 abuts against the outer surface 12 of the support panel 11. The mounting aperture 13 has a diameter less than the maximum outer diameter of the mounting arms 43. Thus, during insertion of the switch assembly 10, the edges of the mounting aperture 13 engage the inclined portions 45 of the mounting arms 43 and cam them inwardly, deforming the inclined portions 45 and the inturned tips 46 of the mounting arms 43 against the outer surface of the housing side wall 31, as best illustrated in FIG. 7, to permit complete insertion of the switch assembly 10 into the mounting aperture 13. When thus mounted in place, the serrations 47 of the mounting arms 43 are resiliently urged outwardly into engagement with the wall of the mounting aperture 13 and become embedded therein to inhibit removal of the switch assembly 10 from the mounting aperture 13. Attachment of the microswitch 15 to the base 20 will now be described. It will be appreciated that the plates 23 and 27 are flexible to permit them to be spread apart a distance sufficient to accommodate insertion of the switch housing 16 therebetween, the stakes 26 being respectively snapped into the bores 19, fixedly to position the microswitch 15 with the plunger 18 thereof disposed just beneath the cylindrical body 21 of the base 20. The plunger 18 is biased outwardly to a fully-extended position illustrated in FIG. 2.

When the microswitch 15 has been attached to the base 20, and after the remainder of the switch assembly 10 has been mounted in the mounting aperture 13, the base 20 is assembled with the housing 30. Thus, the bushing 37 is then threadedly engaged in the opening 22 in the base 20, thereby to clamp the base portion 41 of the mounting member 40 securely between the body 21 of the base 20 and the end wall 33 of the housing 30. When the parts are thus assembled, the plunger 18 of the microswitch 15 is disposed in engagement with the end plate 52, wherein it serves to hold the actuator rod 50 and the push button 55 in a normal rest position wherein the push button 55 projects a slight distance outwardly beyond the annular flange of the housing 30. When the push button 55 is depressed by a user, the plunger 18 will be depressed and actuated.

Figure 9:
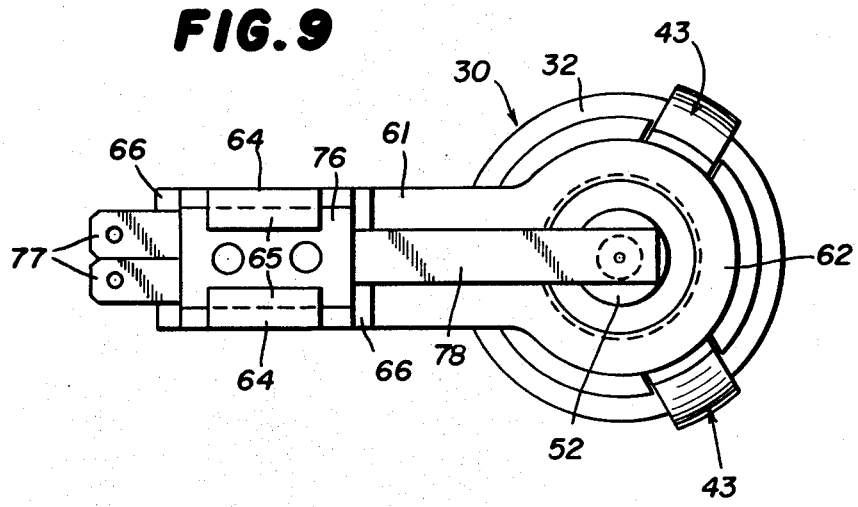
FIG. 9 is a bottom plan view of the switch assembly of FIG. 8.

It is a significant aspect of the present invention that the threaded connection of the base 20 with the housing 30 permits ready removal thereof and is, therefore, suitable for providing interchangeable bases for the switch assembly 10 for mounting different types of switches. Referring now also to FIGS. 8 and 9 of the drawings, there is illustrated an alternative form of the switch assembly 10 utilizing an alternative base, generally designated by the numeral 60, the base 60 being of a type adapted for mounting a leaf switch 75. The base 60 has an elongated body 61 provided at one end thereof with an enlarged part-circular end portion 62, the end portion 62 having an internally threaded opening 63 extending therethrough centrally thereof. Integral with the body 61 adjacent to the other end thereof are two resilient arms 64 projecting therefrom substantially normal thereto and spaced apart a predetermined distance, each of the arms 64 being provided at the distal end thereof with an inturned retaining tab 65. Also integral with the body 61 and projecting therefrom in the same direction as the arms 64, respectively at opposite ends thereof, are two short rectangular retaining flanges 66. The threaded bushing 37 of the housing 30 is adapted to be threadedly engaged in the opening 63 of the base 60, in the same manner as was described above in connection with the base 20.

The leaf switch 75 is of conventional construction and includes a housing 76 provided with terminals 77 and having a pair of elongated flexible resilient contact arms 78 and 79, respectively provided with contact buttons **78*a* and 79*a*. In use, the leaf switch housing 76 is dimensioned to be frictionally received between the arms 64. More specifically, the housing 76 is forced upwardly between the tabs 65, which are preferably provided with upwardly inclined camming surfaces for camming the arms 64 apart to allow passage of the switch housing 76 between the tabs 75. When the switch housing 76 has passed the tabs 65, the arms 64 snap back into place with the tabs 65 engaging the outer surface of the switch housing 76 securely to hold it in place. The housing 76 is also dimensioned so that it will just fit between the retaining flanges 66, which will serve to prevent sliding movement of the housing 76 longitudinally of the base body 61. The parts are so dimensioned that when the leaf switch 75 is thus mounted on the base 60, the contact arms 79 will be disposed for engagement by the end plate 52 of the actuator rod 50. In the normal open condition of the leaf switch 75, the resilient contact arm 79 urges the actuator rod 50 and the push button 55 upwardly to their normal rest position, illustrated in FIG. 8. Operation of the switch assembly 10 with the base 60 and the leaf switch 75, and the mounting thereof on the the support panel 11, are the same as were described above in connection with FIGS. 1 through 7**.

It is a significant aspect of the present invention that all of the parts of the switch assembly 10, including the switch itself, can be assembled and mounted in place on the associated support panel without the use of tools. Furthermore, the parts are relatively few in number and are of simple and economical construction. In a constructional model of the present invention, the bases 20 and 60, the housing 30, the actuator rod 50 and the push button 55 may all be molded of a suitable plastic material. The mounting member 40 may be formed of a spring metal. However, it will be appreciated that other suitable materials could be used. While the bases 20 and 60 are disclosed as threadedly engaged with the housing 30, all three parts could be provided with a series of annular ribs instead of threads so that the parts could be snap-fitted together instead of screwed together.

From the foregoing, it can be seen that there has been provided an improved push button switch assembly which is of simple and economical construction, characterized by ease of assembly and ready adaptability for use with different types of switches.

I claim:

1. A push button assembly for mounting in an aperture in an associated support wall, said assembly comprising a base having an internally threaded opening therethrough, a unitary one-piece housing including a peripheral side wall and an end wall closing said side wall at one end thereof, said end wall including a cylindrical bushing portion having an externally threaded outer end projecting outwardly from said end wall unitary therewith and threadedly engaged in said opening in said base, mounting means having an aperture therethrough and disposable in an assembled condition between said end wall and said base with said bushing portion extending through said aperture, said mounting means in its assembled condition being adapted for engagement with the associated support wall, an actuator member extending through said bushing portion of said end wall for sliding reciprocating movement axially thereof and having an inner end disposed in said housing, and push button means coupled to the inner end of said actuator member for movement therewith and disposed for access by a user at the other end of said housing.

2. The push button assembly of claim 1, wherein said bushing portion is disposed centrally of said end wall and extends coaxially with said side wall.

3. The push button assembly of claim 1, wherein said bushing portion has an inner end projecting from said end wall inwardly of said housing.

4. The push button assembly of claim 1, wherein said base includes switch attachment means for attaching thereto an associated switch.

5. The push button assembly of claim 1, wherein said side wall has a plurality of spaced-apart elongated recesses therein extending from said end wall toward the other end of said housing, said mounting means including a mounting member having a plurality of resilient arms respectively disposed in said recesses and projecting outwardly therefrom adjacent to the other end of said housing.

6. The push button assembly of claim 5, wherein said mounting member has a flat base portion similar in shape to said end wall and disposed along the outer surface thereof, said base portion having an aperture therethrough disposed for receiving therethrough the outer end of said bushing portion, said resilient arms being integral with said base portion at the periphery thereof and projecting therefrom.

7. A push button switch assembly including a base having two opposed resilient switch attachment members and two opposed switch retaining members unitary therewith and projecting therefrom, each of said attachment members having a retaining flange unitary therewith and projecting therefrom at the distal end thereof, a housing carried by said base including a peripheral side wall and an end wall closing said side wall at one end thereof, said end wall having an aperture therethrough, a mounting member coupled to said base and having a plurality of resilient arms respectively disposed for resilient engagement with the associated support wall, an actuator member extending through said aperture in said end wall for sliding reciprocating movement axially thereof and having an inner end disposed in said housing, push button means coupled to the inner end of said actuator member for movement therewith and disposed for access by a user at the other end of said housing, and switch means having a body substantially hexahedral in shape disposed in a mounted position between said attachment members and between said retaining members and between said base and said retaining flanges to that said base and said retaining flanges cooperate to retain said switch body against movement along a first axis and said attachment members cooperate to retain said switch body against movement along a second axis and said retaining members cooperate to retain said switch body against movement along a third axis, said switch means including contact means movable between open and closed conditions and disposed for engagement by the outer end of said actuator member when said switch means is in its mounted position resiliently to urge said actuator member to a normal rest position when said contact means are in the open condition thereof, said actuator member being movable in response to depression of said push button means for moving said contact means to the closed condition thereof.

8. The switch assembly of claim 7, wherein said switch means comprises a microswitch.

9. The switch assembly of claim 7, wherein said switch means comprises a leaf switch.

10. The switch assembly of claim 7, wherein said housing side wall has a plurality of spaced-apart elongated recesses therein extending from said end wall toward the other end of said housing, said resilient arms being respectively disposed in said recesses and projecting outwardly therefrom adjacent to the other end of said housing.

11. The switch assembly of claim 7, wherein said base has an internally threaded opening therethrough, said housing end wall including a cylindrical bushing portion having an externally threaded outer end projecting outwardly from said end wall and threadedly engaged in said opening in said base.

* * * * *